US005720466A

United States Patent [19]

Skipper

[11] Patent Number: 5,720,466

[45] Date of Patent: Feb. 24, 1998

[54] FOLDING BOOK SUPPORT WITH ADJUSTABLE PAGE RETAINERS

[76] Inventor: Ronald G. Skipper, 5610 N. Banana River Blvd., Unit 2, Cocoa Beach, Fla. 32931

[21] Appl. No.: 600,135

[22] Filed: Feb. 12, 1996

[51] Int. Cl.[6] ..... A47B 97/08

[52] U.S. Cl. ..... 248/460

[58] Field of Search ..... 248/460, 441.1, 248/453, 176.1; 43/329, 326, 327, 103, 84, 164

[56] References Cited

U.S. PATENT DOCUMENTS

| | | | |
|---|---|---|---|
| 367,578 | 8/1887 | Babb | 403/329 X |
| 397,627 | 2/1889 | Brown | 248/453 |
| 411,280 | 9/1889 | Donnell | 248/453 |
| 434,262 | 8/1890 | Freeman | 403/329 X |
| 604,389 | 5/1898 | Hamilton | 403/84 |
| 937,480 | 10/1909 | Smith et al. | 403/84 X |
| 1,150,196 | 8/1915 | Howard et al. | 403/84 X |
| 1,923,123 | 8/1933 | Stahlecker | 403/164 |
| 2,950,134 | 8/1960 | Strange | 403/329 |
| 3,583,734 | 6/1971 | Magi | 403/103 X |
| 3,677,510 | 7/1972 | Kenwall . | |
| 3,718,308 | 2/1973 | Hainault . | |
| 3,954,246 | 5/1976 | Sparkman . | |
| 3,991,967 | 11/1976 | Sack . | |
| 4,116,413 | 9/1978 | Andersen . | |
| 4,116,414 | 9/1978 | Robertson . | |
| 4,145,022 | 3/1979 | Comfort . | |
| 4,378,102 | 3/1983 | Portis, Jr. et al. . | |
| 4,436,271 | 3/1984 | Manso . | |
| 4,436,468 | 3/1984 | Ozaki et al. | 403/326 X |
| 4,452,546 | 6/1984 | Hiltebrandt et al. | 403/329 X |
| 4,712,760 | 12/1987 | Winter . | |
| 4,871,139 | 10/1989 | Loewke et al. . | |
| 4,978,096 | 12/1990 | Struckmann . | |
| 5,433,415 | 7/1995 | Samson et al. . | |

FOREIGN PATENT DOCUMENTS

| | | | |
|---|---|---|---|
| 59461 | 2/1924 | Finland | 403/326 |
| 1362630 | 4/1964 | France | 248/460 |
| 956036 | 4/1964 | United Kingdom | 403/326 |
| 1050202 | 12/1966 | United Kingdom | 403/326 |

*Primary Examiner*—Daniel P. Stodola
*Assistant Examiner*—Gregory J. Strimbu
*Attorney, Agent, or Firm*—Paul S. Rooy

[57] ABSTRACT

A foldable book support with adjustable page retainers comprising feet rotatably attached to a back, tubes slidably attached to the feet, and fingers slidably and rotatably attached to the tubes. The tubes in slidable contact with the feet provide book support adjustment to compensate for varying thicknesses of books. The fingers translate longitudinally over the length of the tubes, and by virtue of the fictional fit between the fingers and tubes, provide page retention adjustable to the thickness of pages to be retained. The feet may be held either approximately perpendicular to the back while the book support is in use, or in the alternative, approximately parallel to the back while the book support is being transported or stored.

23 Claims, 7 Drawing Sheets

FOLDING BOOK SUPPORT WITH ADJUSTABLE PAGE RETAINERS

BACKGROUND OF THE INVENTION

1. Field of the Invention

This invention relates to book supports, and in particular to a folding book support with adjustable page retainers.

2. Background of the Invention

During the last millennium, mankind has come to use books as the preeminent means of storing and retrieving written knowledge. Printed books were made in China and Japan approximately one thousand years ago, and gained widespread use in Europe starting about five hundred years ago. Since then, the volume and efficiency of book binding has increased dramatically. Today, some book binding machines are capable of producing over six thousand books per hour.

Accompanying this unprecedented proliferation of books, and consequent dissemination of the knowledge they represent, is the problem of efficiently and conveniently supporting a book being read. This problem surfaces in a number of contexts. When space is limited, such as may occur when a reader is also writing, or when a table contain several reference books (e.g. during legal research), it may be desirable to support a book being referred to in an upright position. Older individuals may suffer from arm fatigue if forced to hold a book upright for long periods of time, especially if the reader suffers from arthritis or other debilitating condition. Bedridden individuals may have an especially hard time reading books while necessarily in a supine position.

Another situation in which book support is desirable is when an individual is reading while partaking of a meal. Many individuals read while eating, in order to maximize the benefits of their mealtimes. Having a book support is important under these circumstances for a number of reason. First, the support allows the person to mad hands-free. Second, the book is supported above and away from the food being consumed, and thus the chances of soiling the book are diminished. Third, if the book support being used allows one-handed page turning, the individual is not required to put aside eating utensils and wipe his hands off prior to turning a page. Therefore, an important feature of any book support is provision for single-handed page turning.

From the examples given thus far, it is also clear that a book support should optimally be collapsible so as to provide for easy transportation and storage, as well as to provide for user convenience. In addition, an important book support design consideration is the ability for the book support to accommodate a wide variety of different book sizes, so as to provide maximum flexibility of use.

EXISTING DESIGNS

A number of patents have been granted for collapsible book supports. For example, U.S. Pat. Nos. 3,991,967, 4,436,271 and 5,433,415 were granted Sack, Manso, and Samson et al. respectively. While these designs taught book supports capable of being folded, the supports disclosed were big and bulky. In addition, these designs were incapable of folding into small, easily transported packages, due to the thickness of their various components.

While U.S. Pat. Nos. 4,378,102 and 4,978,096 were granted to Pettis, Jr. et al. and Struckman respectively for book supports with page retainers, these designs depended on cumbersome string/weights or string/elastic band arrangements to retain book pages open. These designs were complex and therefore costly, and did not appear to provide easy one-handed page turning capability.

Anderson received U.S. Pat. No. 4,116,413 for a collapsible book stand which retained book pages open by means of a horizontally threaded member hingeally attached to a linkage arm and crossbar. This design required the user to laboriously rotate a horizontally threaded member until that portion of the horizontally threaded member length which was disposed internally to the book stand compensated for the thickness of a book being supported. This process rendered the page retention function time-consuming and tedious. Another disadvantage associated with this design was its apparent inability to permit single-handed page turning. Finally, although the invention was collapsible, its folded thickness was rather bulky due to the thickness of its base member.

U.S. Pat. No. 4,954,254 was granted Sparkman for a Book Holder which was collapsible and featured holding arms rotatably attached to its frame. While the holding arms appeared to permit one-handed page mining, they were not adjustable for differing thickness books. In addition, the holding arm lengths were not independently adjustable so as to compensate for the differing page widths of opposite book sides when a book is open to anything other than its middle. Finally, the folded thickness of this book holder was not very compact due to the inherent thickness of its lower channel.

SUMMARY OF THE INVENTION

Accordingly, it is an object of the present invention to provide a folding book support with adjustable page retainers which will accommodate a wide range of book sizes. Design features allowing this object to be accomplished include a tube slidably attached to a foot shaft. Advantages associated with the accomplishment of this object include increased flexibility of use and correspondingly greater utility.

It is another object of the present invention to provide a folding book support with adjustable page retainers whose page retainer lengths are individually adjustable. Design features allowing this object to be accomplished include fingers which are rotatably and slidably attached to tubes, which in turn are slidably attached to foot shafts. Benefits associated with the accomplishment of this object include the ability to retain a book open which is not opened at its middle, and the ability to retain the pages of a wide variety of books open.

It is another object of this invention to provide a folding book support with adjustable page retainers which allows a reader to turn book pages using a single hand. Design features enabling the accomplishment of this object include fingers rotatably and slidably attached to tubes. Advantages associated with the realization of this object include easier operation, and the ability for a person having only one hand available to turn pages.

It is still another object of this invention to provide a folding book support with adjustable page retainers which may be folded. Design features allowing this object to be achieved include fingers rotatably and slidably attached to tubes which are slidably attached to feet, and a back rotatably attached to the feet. Benefits associated with reaching this objective include easier book support transportation and storage.

It is another object of this invention to provide a folding book support with adjustable page retainers which is easy to fold up. Design features allowing this object to be achieved include foot bodies to which a leg and a foot shaft are rigidly attached, a back rotatably attached to the foot bodies, back shafts having back shaft keys attached to the back, and a foot bore having a plurality of foot bore notches in each foot body. A benefit associated with reaching this objective is the capability of quickly and easily folding the book support for transportation or storage, while using only one hand.

It is still another object of this invention to provide a folding book support with adjustable page retainers whose legs and foot shafts automatically assume the correct angle relative to the back when the book support is in the open or the folded configuration. Design features allowing this object to be achieved include back shafts having a back shaft key and foot bores containing foot bore notches sized to admit the foot bore keys. Benefits associated with reaching this objective include easy, automatic folding and unfolding of the book support.

It is another object of this invention to provide a folding book support with adjustable page retainers which folds into a compact package. Design features allowing this object to be achieved include using foot shafts and tubes to support books, instead of a bottom ledge whose thickness would came a greater book support folded thickness. Benefits associated with reaching this objective include a book support whose folded configuration thickness is diminished, thereby providing for easier and more convenient book support transportation and storage.

BRIEF DESCRIPTION OF THE DRAWINGS

The invention, together with the other objects, features, aspects and advantages thereof will be more clearly understood from the following in conjunction with the accompanying drawings.

Seven sheets of drawings are provided. Sheet one contains FIGS. 1 and 2. Sheet two contains FIG. 3. Sheet three contains FIGS. 4 and 5. Sheet four contains FIGS. 6–8. Sheet five contains FIGS. 9 and 10. Sheet six contains FIGS. 11–13. Sheet seven contains FIGS. 14 and 15.

DETAILED DESCRIPTION OF THE PREFERRED EMBODIMENT

Figure 1:
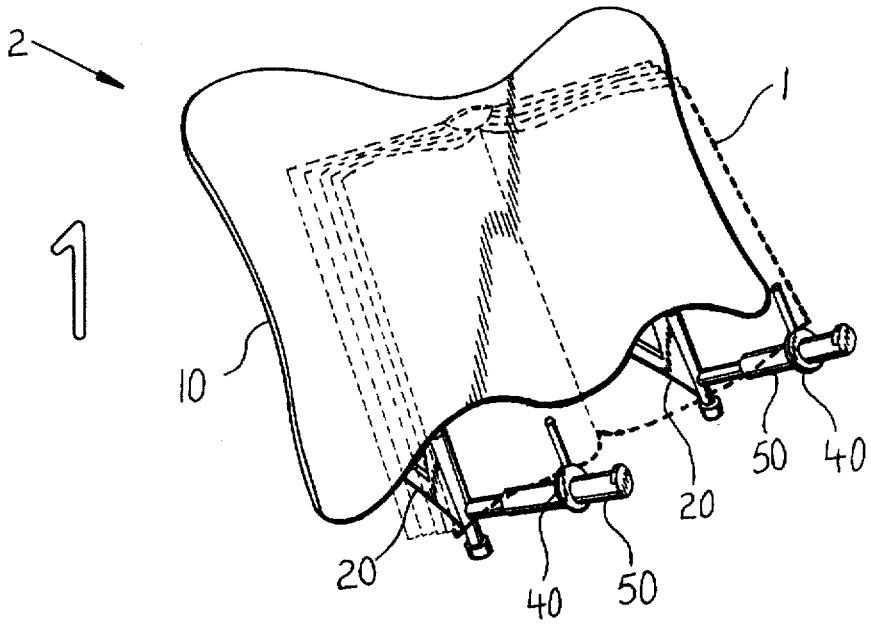
FIG. 1 is a front quarter isometric view of a book support.
Figure 2:
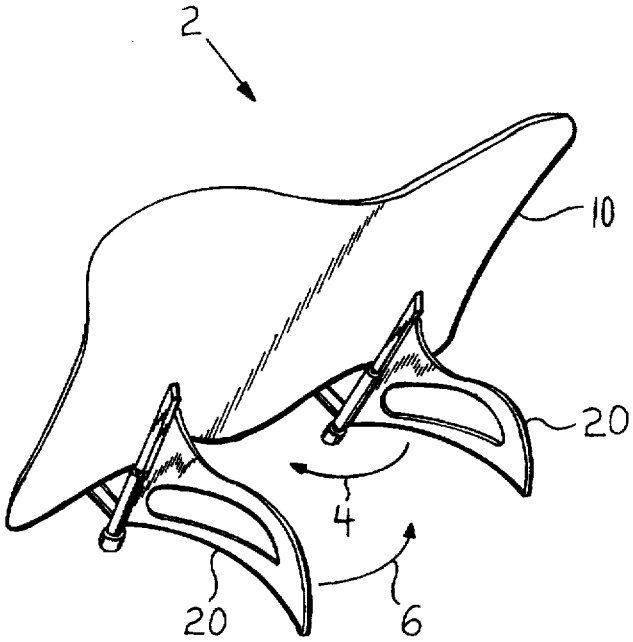
FIG. 2 is a rear quarter isometric view of a book support.

Referring now to FIGS. 1 and 2, a book support 2 is observable in the unfolded configuration. Book 1 is provided vertical support by means of feet 20 and tubes 50, and horizontal support by means of back 10. Book 1 pages are retained in an open position by means of fingers 40. As may be observed in FIG. 2, feet 20 are rotatably attached to back 10. Book support 2 may be folded by rotating feet 20 relative to back 10 as indicated by arrows 4 and 6.

Figure 3:
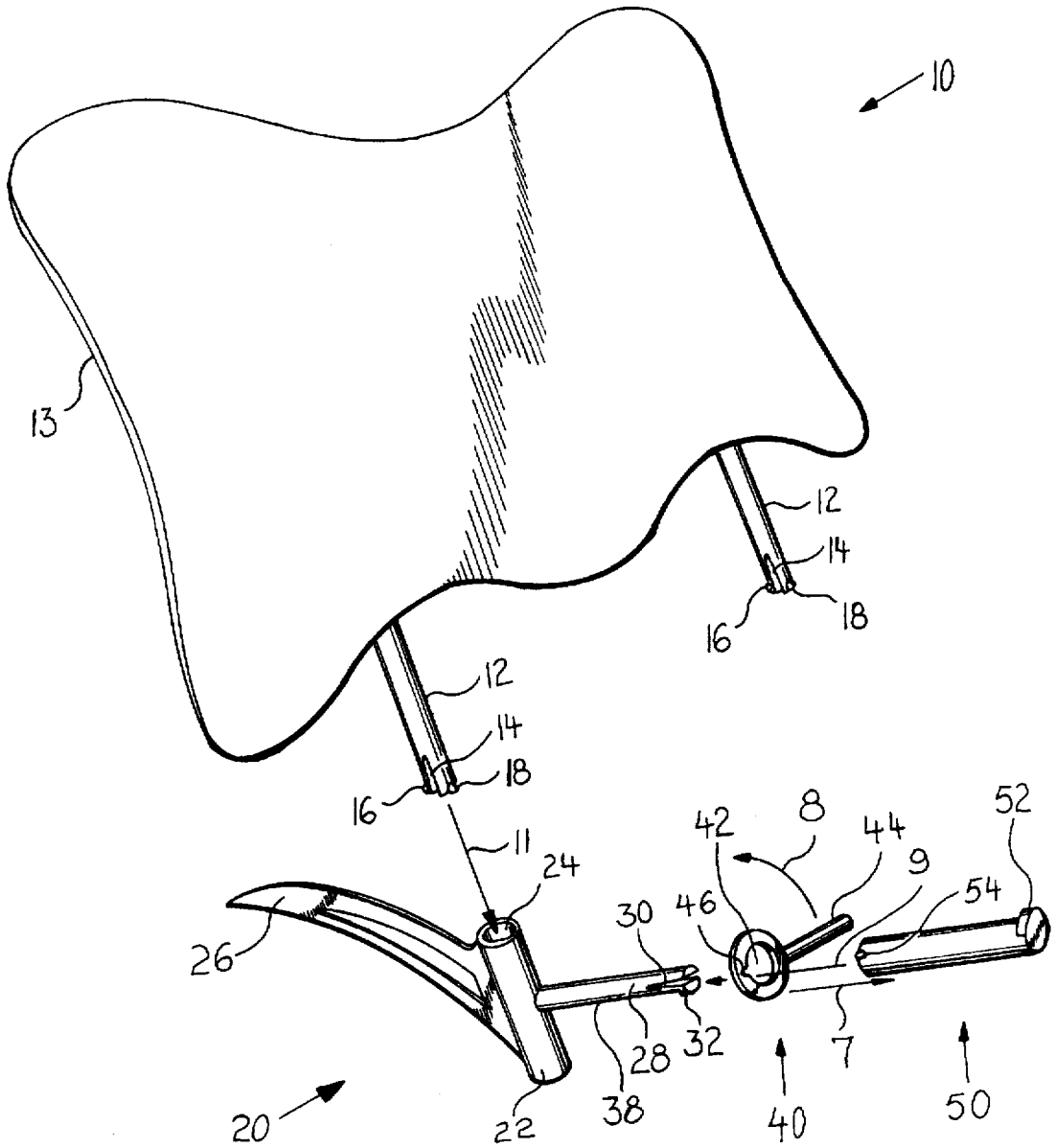
FIG. 3 is a front quarter exploded isometric view of a book support, depicting how a finger is assembled onto a tube, which is in turn assembled onto a foot, and the foot is finally assembled onto a back.

FIG. 3 is a from quarter exploded isometric view of book support 2, depicting how finger 40 is assembled onto tube 50, which is in turn assembled onto foot 20, and foot 20 is finally rotatably assembled onto back 10. FIGS. 4–10 provide detail views of these assembly stages.

In the preferred embodiment, book support 2 is comprised of four basic components: back 10, foot 20 (two each), finger 40 (two each), and tube 50 (two each). Book support 2 is assembled from these components as follows: fingers 40 are assembled onto tubes 50 (as indicated by arrow 7); tubes 50 are assembled onto feet 20 (as indicated by arrow 9), and finally feet 20 are assembled onto back 10 (as indicated by arrow 11).

Figure 4:
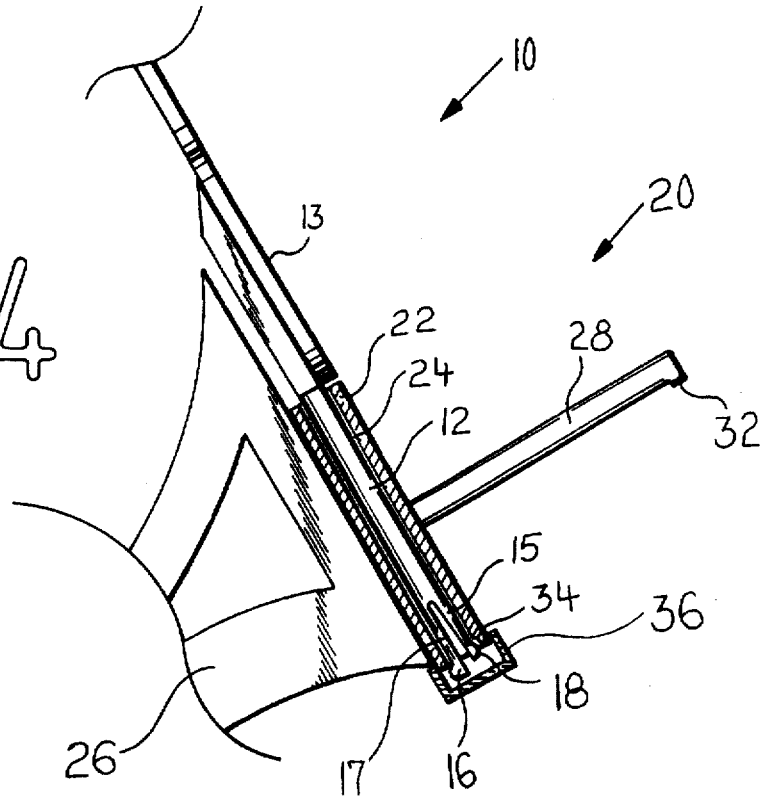
FIG. 4 is a side cross sectional view of a back shaft assembled into a foot.
Figure 5:
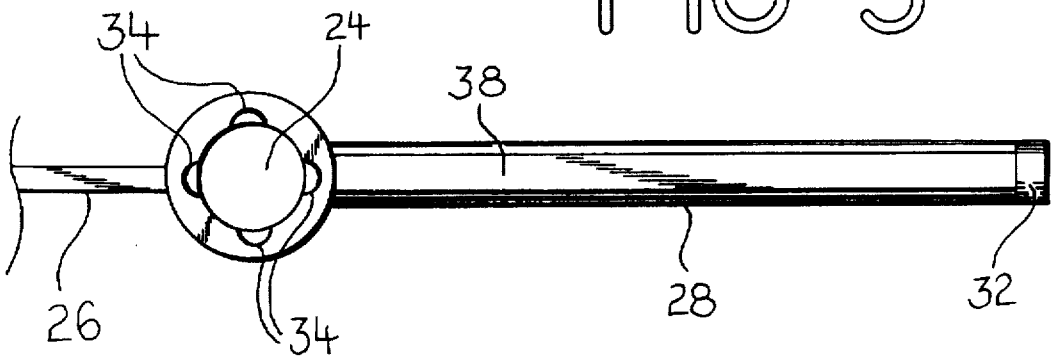
FIG. 5 is a bottom view of a foot.

FIG. 4 is a side cross sectional view of a back shaft 12 assembled into a foot 20. Referring also to FIG. 3, foot 20 comprises foot body 22 having foot bore 24, and leg 26 and feet shaft 28 rigidly attached to foot body 22. FIG. 5 is a bottom view of foot 20. As may be observed in FIGS. 4 and 5, foot bore 24 comprises a plurality of foot bore notches 34 communicating with foot bore 24.

Figure 14:
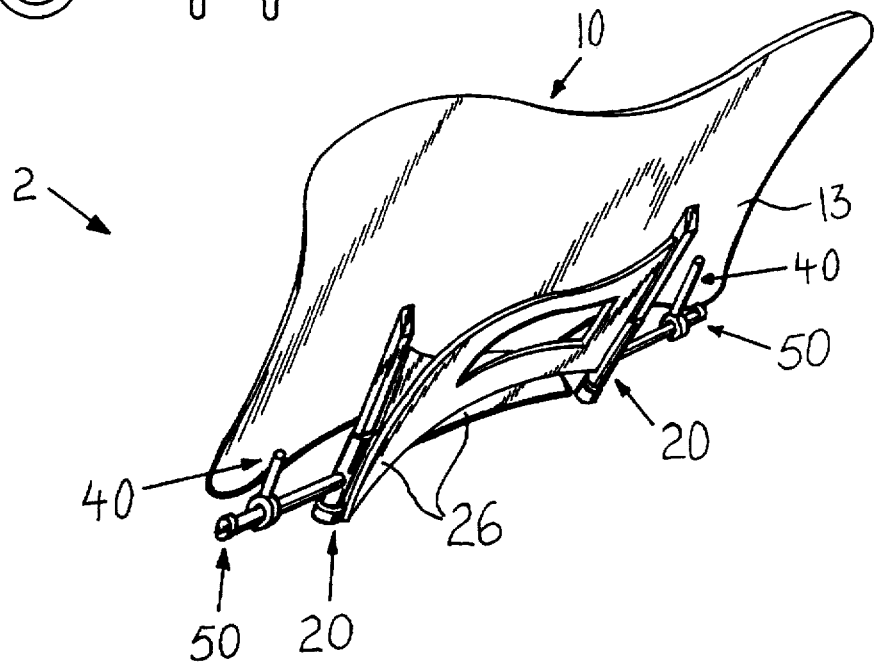
FIG. 14 is a rear quarter isometric view of a book support in the folded configuration
Figure 15:
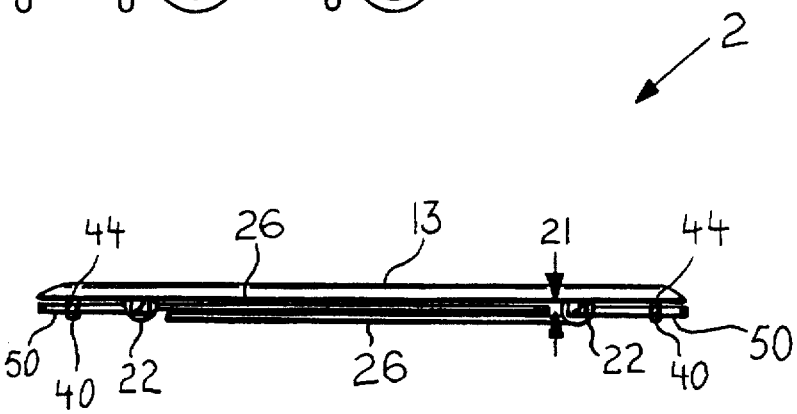
FIG. 15 is a top view of a book support in the folded configuration.

Back 10 comprises back shafts 12 rigidly attached to back support 13. Back shaft notch 14 is disposed at an extreme of back shaft 12 opposite back support 13. Back shaft notch 14 divides an extreme of back shaft 12 opposite back support 13 into back shaft key lobe 15 and back shaft lip lobe 17. Back shaft key 18 is disposed on back shaft key lobe 15, and back shaft lip 16 is disposed on back shaft lip lobe 17. Back shaft key 18 is sized to fit into foot bore notches 34, thereby holding foot 20 at a pre-determined angle relative to back 10 (either in the unfolded configuration as depicted in FIGS. 1 and 2, or in the folded configuration as depicted in FIGS. 14 and 15). Back shaft lip 16 is sized to exceed the diameter of foot bore 24, thereby serving to retain back shaft 12 within foot bore 24, as depicted in FIG. 4.

Foot body cap 36 frictionally fits over an extreme of foot body 22 opposite back support 13. Foot body cap 36 is manufactured of fictional material such as rubber or the like, and serves two functions. First, foot body cap 36 holds back shaft 12 off of a surface upon which book support 2 rests, thereby preventing back shaft 12 from being pushed out of foot bore 24. Second, the frictional material from which body cap 36 is made helps prevent book support 2 from sliding across a surface upon which it rests, which is especially important during single-handed page turning, or where book support 2 rests upon a tilted surface.

Back shaft 12 is manufactured of springy material which permits back shaft key lobe 15 and back shaft lip lobe 17 to be elastically pressed together into close proximity during assembly, in order to insert back shaft 12 into foot bore 24. Once back shaft 12 has been completely inserted into foot bore 24 (until back support 13 butts up against foot body 22, and back shaft lip 16 emerges from an extreme of foot bore 24 opposite back support 13), the memory inherent in the springy material from which back shaft 12 is manufactured urges back shaft key lobe 15 and back shaft lip lobe 17 apart from each other, into the configuration depicted in FIG. 4. In this configuration, back shaft lip 16 rotatably retains back shaft 12 within foot bore 24, and back shaft key 18 is urged into a foot bore 34, thereby providing a mechanical détente which holds foot 20 in the unfolded or in the folded angle configuration relative to back 10. When foot 20 is rotated relative to back 10 in order to fold or unfold book support 2, the springy nature of the foot shaft 12 material permits back shaft key 18 to elastically move out of a foot bore notch 34, translate circumferentially around foot bore 24, and then snap into an adjacent foot bore notch 34 as urged by the mechanical memory inherent in the material of which back shaft 12 is made.

Figure 6:
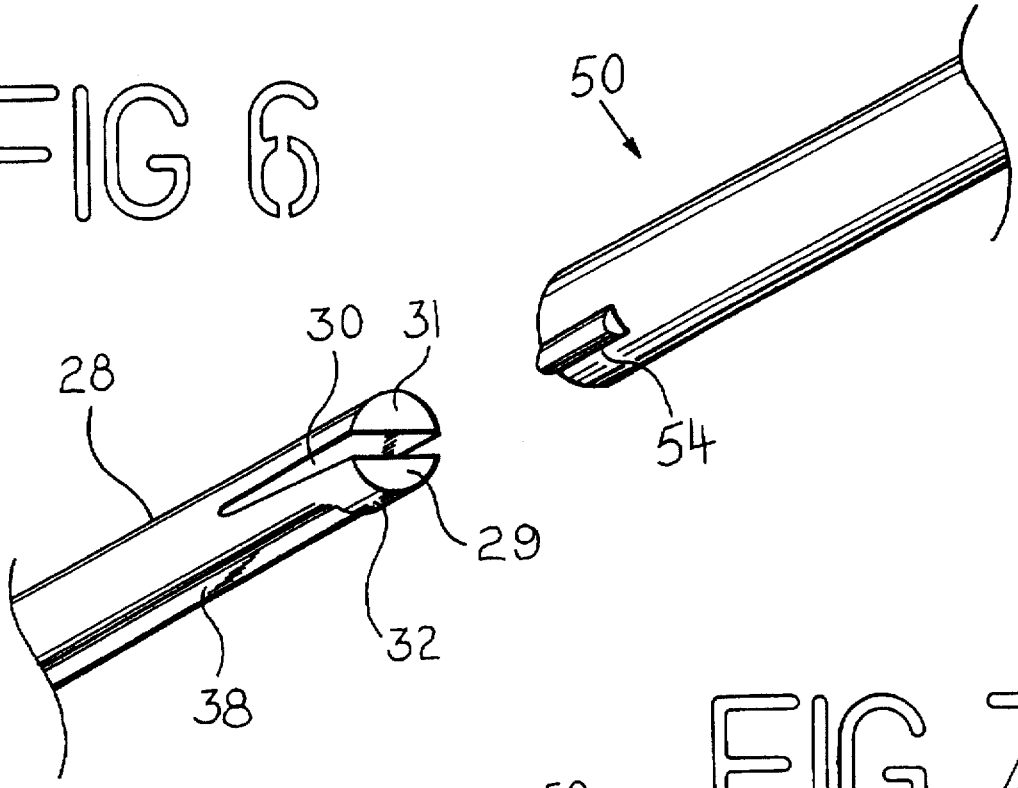
FIG. 6 is a side isometric view of a tube about to be assembled onto a foot shaft.
Figure 7:
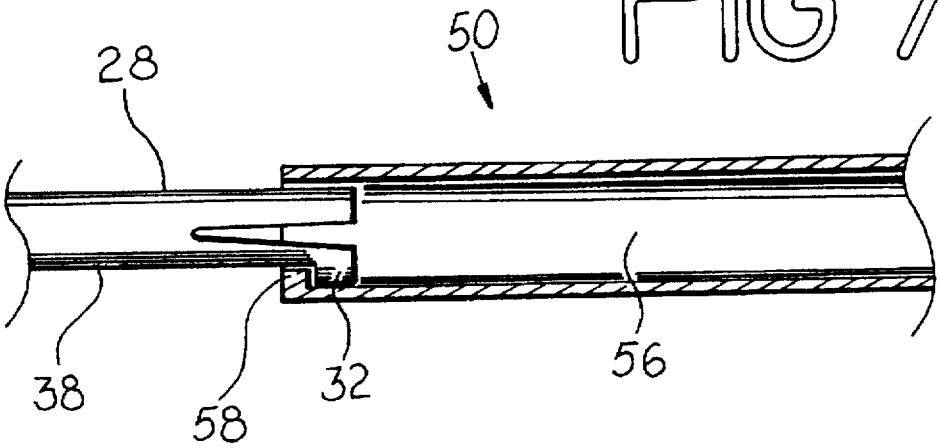
FIG. 7 is a cross-sectional view of a tube assembled onto a foot shaft.
Figure 8:
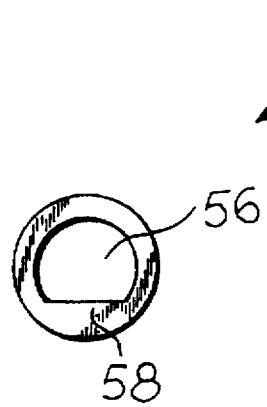
FIG. 8 is an end view of an open end of a tube.

FIGS. 6–8 illustrate how tube 50 is assembled onto foot shaft 28. Foot shaft 28 comprises foot shaft notch 30 at an extreme of foot shaft 28 opposite foot body 22. Foot shaft notch 30 divides an extreme of foot shaft 28 opposite foot body 22 into foot shaft lip lobe 29 and foot shaft non-lip lip lobe 31. Foot shaft lip 32 is disposed on foot shaft lip lobe 31. Foot shaft 28 further comprises foot shaft flat 38, which is disposed on a secant of foot shaft 28 when foot shaft 28 is viewed in cross section. The secant dimension of foot shaft flat 38 remains constant over the length of foot shaft 28.

Tube 50 comprises tube bore 56 having tube bore lip 58, tube lip 52 disposed on an outside surface of tube 50, and tube key 54 disposed on an outside surface of tube 50. Tube bore 56 and tube bore lip 58 (see the end view of tube 50 depicted in FIG. 8) are sized to non-rotatably, slidably and frictionally admit that portion of foot shaft 28 which comprises foot shaft flat 38.

While the preferred embodiment of book support 2 employs a foot shaft flat 38 to render foot 20 non-rotatably, slidably and frictionally engaged with tube 50, it is contemplated by this disclosure that any foot shaft 28 cross-section which is not an un-interrupted circle, in combination with a mating tube bore 56/tube bore lip 58 shape, may be employed for this purpose.

Foot shaft 28 is manufactured of springy material which permits foot shaft lip lobe 29 and foot shaft non-lip lobe 31 to be elastically pressed together into close proximity in order to insert foot shaft 28 into tube bore 56 for assembly. Once foot shaft 28 has been assembled into tube bore 56 (that is, inserted until foot shaft lip 32 dears tube bore lip 58), the memory inherent in the springy material from which foot shaft 28 is manufactured urges foot shaft lip lobe 29 and foot shaft non-lip lobe 31 apart from each other, into the configuration depicted in FIG. 7. In this configuration, foot shaft lip 32 in combination with tube bore lip 58 slidably, frictionally and non-rotatably retain foot shaft 28 within tube bore 56.

The combined length of foot shaft 28 and tube 50 may be changed to accommodate differing thicknesses of books which may be supported by book support 2. Once a reader has set a combined length of foot shaft 28 and tube 50, tube 50 will tend to retain its position relative to foot shaft 28, by virtue of the frictional fit between foot shaft 28 and tube 50.

Figure 9:
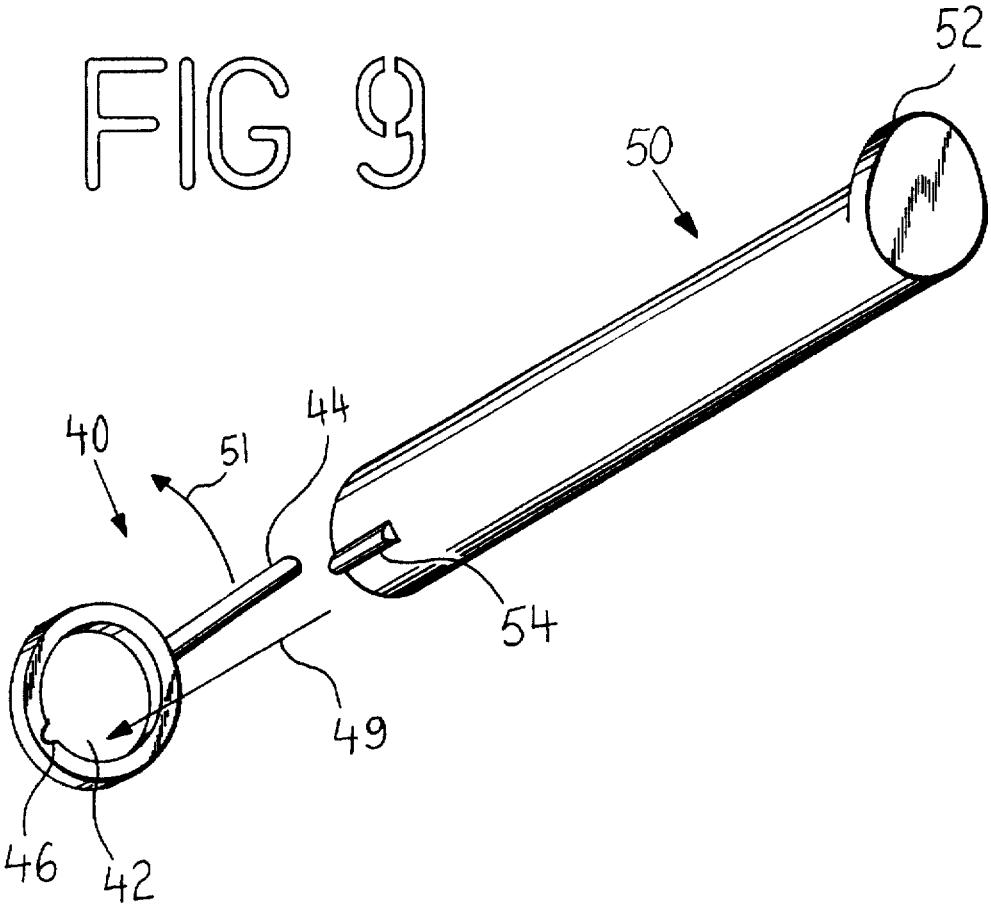
FIG. 9 is a side isometric view of a finger about to be assembled onto a tube.
Figure 10:
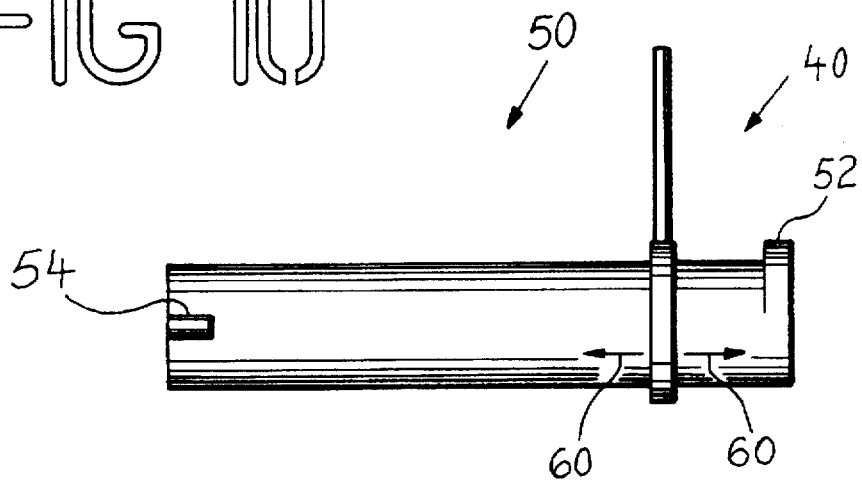
FIG. 10 is a side isometric view of a finger assembled onto a tube.

FIGS. 9 and 10 depict finger 40 being assembled onto tube 50. Tube 50 comprises tube key 54 at one extreme, and tube lip 52 at an opposite extreme. As illustrated in FIG. 8, the shape of tube 50 is a cylinder, and tube key 54 is a protuberance on the outside of tube 50.

Finger 40 comprises peg 44, and finger bore 42 interrupted by finger bore keyway 46. Finger bore 42 is sized to frictionally and rotatably admit tube 50. Finger bore keyway is sized to admit tube key 54. Finger 40 is assembled onto tube 50 by inserting tube 50 and tube key 54 through finger bore 42 and finger bore keyway 46 respectively, as indicated by arrow 7 in FIG. 3 an arrow 49 in FIG. 9. Once finger bore keyway 46 has cleared tube key 54, finger 40 is rotated around tube 50 as indicated by arrow 8 in FIG. 3 and arrow 51 in FIG. 9, until peg 44 is upright (the peg 44 position illustrated in FIG. 10). Finger 40 is free to translate axially along the length of tube 50, against the friction between finger bore 42 and tube 50, as is illustrated by arrows 60.

Finger bore 42 is sized to frictionally and rotatably admit tube 50 such that once a reader has manually positioned finger 40 along the length of tube 50, and has set the angular relationship between peg 44 and tube 50, finger 40 will tend to remain in that reader-determined position against the urgings of the pages of a book 1 supported by book support 2. In this fashion, fingers 40 may be individually positioned along the lengths of tubes 50 in order to accommodate different sizes of books, or different page thicknesses contained by opposite sides of on open book 1 supported by book support 2.

Figure 11:
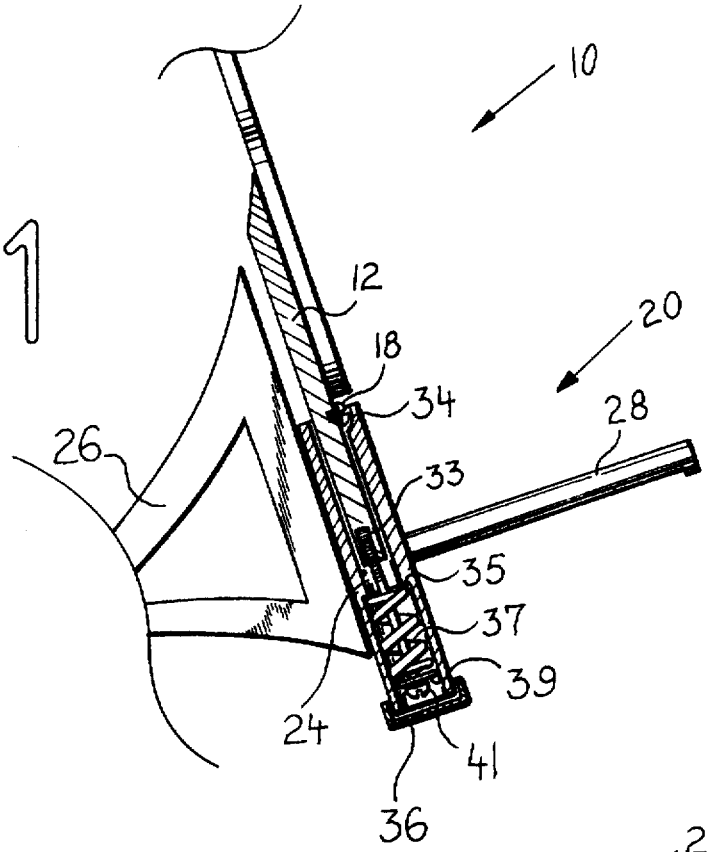
FIG. 11 is a side cross-sectional view of an alternate embodiment foot assembled onto an alternate embodiment back shaft.

FIG. 11 is a side cross-sectional view of an alternate embodiment foot 20 assembled onto an alternate embodiment back 10. In this embodiment, foot bore 24 incorporates foot bore notches 34 at its upper extreme, and also incorporates foot bore lip 35. Back shaft 12 comprises back shaft threaded bore 33, back shaft key 18 sized to fit into foot bore notches 34, bolt 41 sized to mate with back shaft threaded bore 33, washer 39 sized to fit into foot bore 24 and to admit bolt 41, and spring 37 sized to seat on foot bore lip 35 and to admit bolt 41. Spring 27 is pre-loaded in compression between washer 39 and foot bore lip 35, and thus urges back shaft key 18 (a screw head in this illustration) into foot bore notches 34.

Spring 37 urges back shaft key 18 into a foot bore 34, thereby providing a mechanical détente which holds foot 20 in the unfolded or in the folded angle configuration relative to back 10. When foot 20 is rotated relative to back 10 in order to fold or unfold book support 2, spring 37 compresses in order to permit back shaft key 18 to move out of a foot bore notch 34, translate circumferentially around foot bore 24, and then snap into an adjacent foot bore notch 34 as urged by spring 37.

Figure 12:
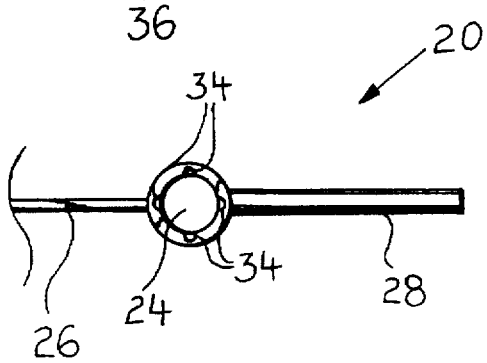
FIG. 12 is a bottom view of the alternate embodiment foot depicted in FIG. 11.

FIG. 12 is a bottom view of the alternate embodiment foot depicted in FIG. 11. Foot bore notches 34 are visible, and serve to hold foot 20 in either the folded or unfolded position.

Figure 13:
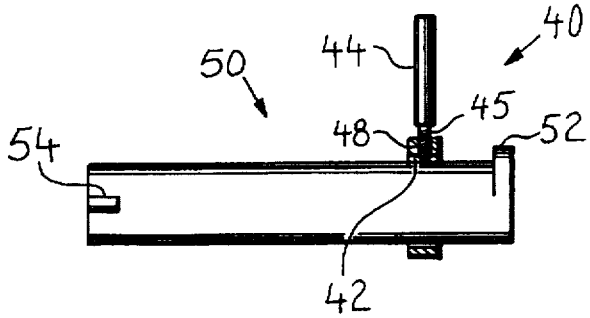
FIG. 13 is a side cross-sectional view of an alternate embodiment finger assembled onto a tube.

FIG. 13 is a side cross-sectional view of an alternate embodiment of finger 40 assembled onto tube 50. In this alternate embodiment, finger 40 comprises a radially disposed finger threaded bore 48 communicating with finger bore 42, and finger bore 42 is sized to freely admit tube 50. Peg threaded stud 45 is rigidly attached to peg 44 and is sized to mate with finger threaded bore 48. In this alternate embodiment, finger 40 is locked in position on tube 50 by tightening peg threaded stud 45 onto tube 50 by rotating peg 44. When a reader desires to re-position finger 40, the reader unscrews peg threaded stud 45 by rotating peg 44, moves finger 40 to the desired axial and angular position relative to tube 50, and then re-tightens peg threaded stud 45 on tube 50 by rotating peg 44.

FIG. 14 is a rear quarter isometric view of a book support in the folded configuration. Feet 20 have been rotated relative to back 10 (as indicated by arrows 4 and 6 in FIG. 1) until legs 26 lie flat against back support 13. The action of rotating feet 20 also rotates foot shafts 28 (with tubes 50 and fingers 40 attached) so that tubes 50 also lie flat against back support 13.

Note that pegs 44 in the upright position (as illustrated in FIG. 1) may prevent foot shafts 28 (with tubes 50 and fingers 40 attached) from passing under back support 13 when book support 2 is being folded, because pegs 44 may contact back support 13. There are two ways to prevent this. First, tubes 50 and fingers 40 may be translated full travel (on foot shafts 28 and tubes 50 respectively) away from foot body 22, feet 20 are folded, and finally tubes 50 are translated full travel on foot shafts 28 toward foot body 22. Second, prior to folding feet 20, fingers 40 may be rotated relative to tubes 50 until pegs 44 point down, feet 20 are then folded, and finally pegs 44 are rotated relative to tubes 50 until pegs 44 point up.

FIG. 15 is a top view of book support 2 in the folded position. Tubes 50 have been translated full travel on foot shafts 28 toward foot bodies 22. Fingers 40 have been rotated relative to tubes 50 until pegs 44 point up, flat against back support 13. Note that in order to facilitate folding book support 2, one leg 26 may be offset on foot body 22 by a distance 21 equal to the thickness of the other leg 26.

As may be observed in FIG. 14 and especially in FIG. 15, when book support 2 is in the folded configuration, back shafts 12, feet 20, tubes 50 and fingers 40 are all substantially coplanar with back support 13. Thus, when folded, book support 2 presents a compact, thin package, that may be easily stored or transported. In the folded configuration, book support 2 is sufficiently small to fit into a three-ring binder document holder.

In the preferred embodiment, all book support 2 components were manufactured from plastic, synthetic (such as 33% fiber-filled nylon), wood, or other appropriate material.

A variety of appropriate materials is contemplated to use in the manufacture of the alternate embodiment book support 2 depicted in FIGS. 11–13. Back support 13 may be fabricated of wood, metal, synthetic (such as clear Lucite), or other appropriate material. Back shafts 12, feet 20, fingers 40 and tubes 50 may be manufactured of wood, metal (such as brushed aluminum or brass), synthetic, or other appropriate material. Spring 37, washer 39, back shaft key 18, and bolt 41 are standard items, manufactured of steel, aluminum, synthetic, or other appropriate material.

Unfolding Book Support 2

A. Either: (i) translate tubes 50 and fingers 40 (on foot shafts 28 and tubes 50 respectively) full travel away from foot body 22, or (ii) rotate fingers 40 relative to tubes 50 until pegs 44 point down.

B. Unfold feet until they are approximately at a right angle relative to back support 13.

C. Translate tubes 50 on foot shafts 28 until they are disposed at an appropriate location to accommodate the thickness book 1 which is to be supported on book support 2.

D. Rotate pegs 44 relative to tubes 50 until pegs 44 point up.

E. Translate fingers 40 on tubes 50 until they are disposed at an appropriate location to accommodate the thickness book which is to be supported on book support 2.

Adjusting Fingers 40 for Book Size

A. Translate fingers 40 on tubes 50 until they are disposed at an appropriate location to accommodate the thickness book which is to be supported on book support 2.

One-Handed Page Turning

A. Grasp a page to be turned by its upper edge.

B. Pull the page to be turned upwards until its bottom edge disengages from the peg 44 retaining it in position.

C. Turn the page.

D. Pull the page which has just been turned upwards until its bottom edge clears the peg 44 on the side of the book towards which the page was turned.

E. Gently push the turned page downwards until it rests in position behind the peg 44 on the side of the book towards which the page was turned.

Folding Book Support 2

A. Either: (i) translate tubes 50 and fingers 40 (on foot shafts 28 and tubes 50 respectively) full travel away from foot body 22, or (ii) rotate fingers 40 relative to tubes 50 until pegs 44 point down.

B. Fold feet 20 until legs 26 rest flat against back support 13.

C. Translate tubes 50 full travel on foot shafts 28 toward foot bodies 22. Rotate fingers 40 relative to tubes 50 until pegs 44 point up, flat against back support 13.

While a preferred embodiment of the invention has been illustrated herein, it is to be understood that changes and variations may be made by those skilled in the art without departing from the spirit of the appending claims.

DRAWING ITEM INDEX

1 book
2 book support
4 arrow
6 arrow
7 arrow
8 arrow
9 arrow
10 back
11 arrow
12 back shaft
13 back support
14 back shaft notch
15 back shaft key lobe
16 back shaft lip
17 back shaft lip lobe
18 back shaft key
20 foot
21 distance
22 foot body
24 foot bore
26 leg
28 foot shaft
29 foot shaft lip lobe
30 foot shaft notch
31 foot shaft non-lip lobe
32 foot shaft lip
33 back shaft threaded bore
34 foot bore notch
35 foot bore lip
36 foot body cap
37 spring
38 foot shaft flat
39 washer
40 finger
41 bolt
42 finger bore
44 peg
45 peg threaded stud
46 finger bore keyway
48 finger threaded bore

49 arrow
50 tube
51 arrow
52 tube lip
54 tube key
56 tube bore
58 tube lip
60 arrow

I claim:

1. A folding book support comprising a back, at least one foot, at least one tube, at least one finger slidably and rotatably attached to said tube, a means of rotatably attaching said foot to said back, said at least one that comprising a foot shaft, and each said tube comprising a tube bore sized to slidably admit one said foot shaft, whereby said tube is free to reciprocate relative to said foot shaft along a centerline of said foot shaft.

2. The folding book support of claim 1 further comprising a means of interruptably holding said at least one foot in one of a first and a second position, the first said position being approximately parallel to said back, and the second said position being approximately perpendicular to said back.

3. The folding book support of claim 2 wherein said means of interruptably holding said at least one foot in one of a first and a second position comprises a foot bore in said foot, foot bore notches in said foot bore, a back shaft attached to said back manufactured of resilient material and sized to fit in said foot bore, a back shaft key on said back shaft sized to engage one said foot bore notches, and a back shaft notch dividing said back shaft into a back shaft key lobe and a back shaft lip lobe, said back shaft key being disposed on said back shaft key lobe, whereby the back shaft resilient material urges said back shaft key lobe away from said back shaft lip lobe, thereby urging said back shaft key into engagement with one said foot bore notches.

4. The folding book support of claim 1 further comprising a means of preventing said tube from rotating relative to said foot.

5. The folding book support of claim 4 wherein said means of preventing said tube from rotating relative to said foot comprises a tube bore in said tube, a tube bore lip in said tube bore, and a foot shaft flat on said foot shaft, said tube bore lip and said tube bore being sized to slidably and frictionally admit a portion of said foot shaft comprising said foot shaft flat.

6. The folding book support of claim 5 further comprising a means of retaining said tube on said foot shaft.

7. The folding book support of claim 6 wherein said means of retaining said tube on said foot shaft comprises a foot shaft lip on said foot shaft and a means of urging said foot shaft lip away from a foot shaft centerline, a cross-sectional area of the combination of said foot shaft and said foot shaft lip exceeding a cross-sectional area of said tube bore as reduced by said tube bore lip, whereby said foot shaft is retained within said tube bore.

8. The folding book support of claim 7 wherein said means of urging said foot shaft lip away from a foot shaft centerline comprises said foot shaft manufactured of a resilient material, and a foot shaft notch dividing said foot shaft into a foot shaft lip lobe and a foot shaft non-lip lobe, said foot shaft lip being disposed on said foot shaft lip lobe, whereby said foot shaft resilient material urges said foot shaft lip lobe away from said foot shaft non-lip lobe.

9. The folding book support of claim 8 wherein said resilient material is a synthetic material.

10. The folding book support of claim 1 wherein said means of rotatably attaching said foot to said back comprises a back shaft attached to said back and a foot bore in said at least one foot, said foot bore being sized to admit said back shaft.

11. The folding book support of claim 1 wherein said finger comprises a finger bore sized to frictionally admit said tube, and said tube and said finger bore are circular in cross section.

12. The folding book support of claim 11 further comprising an means of retaining said finger on said tube.

13. The folding book support of claim 12 wherein said means of retaining said finger on said tube comprises a tube lip on said tube, a tube key on said tube, and a finger bore keyway in said finger bore, said finger bore keyway being sized to admit said tube key.

14. The folding book support of claim 1 further comprising a means of retaining said at least one foot in rotatable attachment with said back.

15. The folding book support of claim 14 wherein said means of retaining said at least one foot in rotatable attachment with said back comprises a foot bore in said foot, a back shaft sized to fit into said foot bore attached to said back, a back shaft lip on said back shaft, and a means of urging said back shaft lip away from a back shaft centerline, a cross sectional dimension of a combination of said back shaft and said back shaft lip exceeding a diameter of said foot bore.

16. The folding book support of claim 15 wherein said means of urging said back shaft lip away from a back shaft centerline comprises a back shaft manufactured of a resilient material, and a back shaft notch dividing said back shaft into a back shaft key lobe and a back shaft lip lobe, said back shaft lip being disposed on said back shaft lip lobe, whereby the back shaft resilient material urges said back shaft key lobe away from said back shaft lip lobe, thereby urging said back shaft lip away from said back shaft ceterline.

17. The folding book support of claim 16 wherein said resilient material is a synthetic material.

18. A folding book support comprising a back, two feet rotatably attached to said back, a foot shaft attached to each said foot, a tube comprising a tube, bore slidably attached to each said foot, each said tube bore being sized to slidably admit one said foot shaft whereby said tube is free to reciprocate relative to said foot shaft along a centerline of said foot shaft.

19. The folding book support of claim 18 wherein:

said back comprises two back shafts attached to a back support;

each foot is rotatably attached to one said back shaft, and comprises a leg and said foot shaft attached to a foot body, a foot bore in said foot body sized to admit one said back shaft, and a foot body cap enclosing an extreme of said foot body opposite said back support; and a finger is slidably and rotatably attached to each said tube, each said finger comprising a peg and a finger bore, said finger bore being sized to frictionally admit said tube.

20. A folding book support comprising a back, two feet rotatably attached to said back, at least one finger rotatably attached to each said foot, and a means of releasably locking said feet in one of a first and a second position, the first said position being approximately parallel to said back, and the second said position being approximately perpendicular to said back.

21. The folding book support of claim 20 wherein said means of releasably locking said feet in one of a first and a second position comprises a foot bore in each said foot, foot bore notches in each said foot bore, back shafts manufactured of resilient material sized to fit in each said foot bore, attached to said back, a back shaft key on each said back shaft sized to engage said foot bore notches, and a back shaft notch dividing each said back shaft into a back shaft key lobe and a back shaft lip lobe, said back shaft keys each being disposed on said back shaft key lobe, whereby the back shaft resilient material urges said back shaft key lobe away from said back shaft lip lobe, thereby urging said back shaft key into engagement with said foot bore notches.

22. The folding book support of claim 21 further comprising a tube attached to each said foot, said fingers slidably attached to each said tube, each said finger comprising a finger bore sized to freely admit said tube, a finger threaded bore in said finger communicating with said finger bore, and a peg threaded stud sized to mate with said finger threaded bore, whereby rotation of said peg threaded stud will cause said peg threaded stud to tighten on said tube.

23. The folding book support of claim 20 wherein said means of releasably locking said feet in one of a first and a second position comprises:

a foot bore in each said foot comprising a plurality of foot bore notches and a foot bore lip;

back shafts sized to fit into each said foot bore and attached to said back, said back shafts each comprising a back shaft threaded bore, a back shaft key sized to fit into said foot bore notches, a bolt sized to mate with said back shaft threaded bore, a washer sized to fit into said foot bore and to admit said bolt, and a spring sized to seat on said foot bore lip and to admit said bolt, said spring being constrained in compression by said bolt, said spring being disposed between said washer and said foot bore lip, said bolt being disposed through said washer and said spring, and threaded into said back shaft threaded bore.

* * * * *